United States Patent [19]

Kozan

[11] 4,209,085

[45] Jun. 24, 1980

[54] PORTABLE RECREATIONAL PRODUCT ASSEMBLY

[76] Inventor: Eileen N. Kozan, 1121 45th Ave. N., St. Petersburg, Fla. 33703

[21] Appl. No.: 939,436

[22] Filed: Sep. 5, 1978

[51] Int. Cl.[2] ..... A45C 3/00; A45C 13/00

[52] U.S. Cl. ..... 190/51; 206/315 R; 150/1.6; 190/42

[58] Field of Search ..... 190/51, 42; 150/1.6; 206/315; 220/20, 21, 22

[56] References Cited

U.S. PATENT DOCUMENTS

| | | | |
|---|---|---|---|
| 3,199,643 | 8/1965 | Korchmar | 190/51 |
| 3,537,552 | 11/1970 | Noble | 190/51 |
| 3,967,869 | 7/1976 | Jackson | 190/51 X |

*Primary Examiner*—George T. Hall
*Attorney, Agent, or Firm*—John Orman

[57] ABSTRACT

A portable combination recreational product assembly and conventional container designed and configured primarily in the structure of a briefcase or like conventional container, wherein the product assembly is formed in a predetermined portion of the interior of the housing of the briefcase or conventional container and is segregated from a primary storage area by a panel element movably connected on the interior of the housing of the conventional container. The primary storage area is specifically dimensioned and configured to hold documents or like articles in the normal fashion. The product assembly represents a secondary storage area having a substantially hollow interior in which is mounted a plurality of individual, segregated compartments of varying sizes and configurations for the purpose of holding the various recreational articles or products therein and in totally separated relation to the articles being maintained in the primary storage area. The entire structural embodiment thereby defining a recreational kit or built in "play world" having a normal utilitarian function of carrying various documents, articles or the like in the conventional fashion but yet having separate compartmentalized interior portions for carrying recreational articles to be utilized during spare time or as desired by the carrier of the portable recreational product assembly.

10 Claims, 2 Drawing Figures

PORTABLE RECREATIONAL PRODUCT ASSEMBLY

BACKGROUND THE INVENTION

1. Field of the Invention

This invention relates to the combination recreational product assembly incorporated on the interior of what may be considered a conventional document carrier such as a briefcase or the like wherein recreational articles or products are carried in a completely segregated fashion from the normal or conventional articles maintained in a briefcase and utilized for normal or business activities.

2. Description of the Prior Art

With the increase in modern technology and the comparative increase in the executive category of the modern day work force leisure time during as well as time available after work has been greatly increased. Accordingly, numerous people find themselves with ample amounts of leisure time. An increasing number of such people have turned to various forms of recreation in order to pass away the leisure or idle time during the normal work day schedule. Typically, such extra leisure time occurs in relatively small segments of approximately an hour. Such small segments of leisure time do not allow a person to participate in the more typical or active leisure time activities such as golf, tennis, etc. Therefore, more and more leisure time activities are concerned with the playing of games involving the utilization of both intellectual and physical toys rather than wasting such time by typically doing nothing.

Such games of course take a wide variety and range from card playing, dice games, chess, checkers, backgammon, as well as the utilization of relatively small, compact exercise devices such as balls and paddles, hand exercisers, jump rope etc. Such games and light exercise apparatus are widely available on the commercial market and as set forth above, take a wide variety of designs, functions and include numerous types of apparatus.

In order to add to the selection availability of the participants in such games numerous commercial package are presently available. Such packages include a plurality of games housed in a single game-type package so as to allow the participants to play one of a number of such games. This prevents or reduces the possibility of boredom with a single-type game or exercise apparatus.

However, the industry still faces the problem of properly packaging the individual or compiled games so as both to be attractive to the various participants and make it generally convenient for such participants to transport these games and/or the game package during their everyday work or activity. It can be readily seen that any extra package or package designed solely for the carrying of such games quickly becomes burdensome in that the participant has to thereby carry at least one extra article (game package) in addition to his normal tools, utensils, briefcases, etc.

Therefore, it can be seen that there is a great need in the industry for a package or product assembly which is specifically structured to be a part of a normal housing, casing or conventional container for other articles so as to make such product assembly more attractive to the average participant. This is true especially in the "executive" category of workers wherein such workers generally carry a briefcase, attache case or like conventional container in which they maintain various documents, files, etc. Therefore, it is obvious that adaptability and specific structure of a product assembly specifically designed and configured to house a plurality of games and games, toys and/or exercise apparatus would be readily acceptable to the consuming public as well as the packaging industry and those involved in the manufacture and sale of such game and exercise apparatus.

Such product assembly would have to be compact, relatively inexpensive to manufacture and maintain and have a sufficient operable life to be useful over a long period of time under relatively harsh or unfavorable environmental conditions. This product assembly should be designed to allow the owner or user to relax from daily pressures and will aide in the release of tensions by providing a change of pace. This release allows the user to continue to work at a more effective level, relaxed, refreshed, or while traveling over-night. The client will have the sources of recreation with him in the form of a "built in play world".

SUMMARY OF THE INVENTION

This invention is directed towards a recreational product assembly or built in "play world" specifically designed to be incorporated into a conventional container such as a briefcase, attache case or like conventional container. Such container is considered to be portable and thereby designed to be transported directly with the participant or user of the recreational product assembly.

More specifically the product assembly is convertible into a conventional container for holding documents, files, etc., and comprises a housing having a base portion and a lid means movably attached to one another in a pivotal fashion. This pivotal attachment is accomplished through the utilization of hinge means interconnected between the lid means and the base. Both the lid means and the base are configured to have a substantially hollow configuration so as to define a generally hollow interior of the housing. This hollow interior is in turn defined by a primary storage area and a secondary storage area. Both of the storage areas are segregated from one another by the existence of a panel means which itself is movably connected to the interior of the housing and, preferably, pivotally and movably attached to the interior portion of the base means.

The primary storage area, in the preferred embodiment, is at least partially defined by the interior of the lid means and one correspondingly positioned surface of the panel means. The secondary storage area in turn is primarily defined at least in part by the interior of the base portion and a correspondingly positioned surface of the panel means which is located opposite to the surface of the panel means which defines the primary storage area.

The panel means itself is, as set forth above, pivotally or movably attached to the interior of the base means and specifically configured and disposed to be moved into and out of a closed and/or partially sealed relation relative to the secondary storage area. Accordingly, the secondary storage area defines a separate, segregated volume of space from the volume of space of the primary storage area. The panel means is further specifically configured so as to appear as a "false bottom" in the base means and the correspondingly position surface of the panel means relative to the primary storage area serves as a main base or support platform on which to position or secure documents, files or like articles when the housing is in an upright position. Accordingly, the panel means thereby serves as a type of secondary lid for the volume which defines the secondary storage area. As will be explained in greater detail hereinafter this secondary lid defined by the panel means serves to prevent recreational products stored in the secondary storage area from being inadvertently removed from the secondary storage area or accidentally being spilled therefrom.

The secondary storage area further comprises compartment means in the form of at least one and preferably a plurality of compartments disposed in spaced apart substantially separated relation from one another and specifically configured to hold various types of recreational articles or products. As set forth above such recreational products or articles could include checkers, dice, marbles, tiddlywinks, various game boards, jump ropes, ball and paddle exercise devices, hand exercisers as well as various types of mechanical or intellectual toys, puzzles, etc.

It is further contemplated for at least one of the compartments of the plurality of compartments disposed within the secondary storage area to be insulated and substantially sealed from the remainder of such other plurality compartments. In this insulated single compartment numerous types of food stuffs, drinks, etc., can be stored for a reasonable length of time and still maintain the desired temperature for prevention from spoilage, etc.

Another structural feature of the present invention comprises a board mounting means which is attached to the panel means and more specifically the surface correspondingly positioned to the secondary storage means. This board mounting means comprises clip means or bracket means attached in spaced apart relation to one another so as to grip securely but removably peripheral surfaces or edges of a playing board. Such playing boards, as set forth above, take the form of checkerboards, chessboards, parchesi boards, backgammon boards, etc. Accordingly, the clip means or bracket means are so positioned so as to securely hold the playing board in place immediately adjacent and in engagement with the correspondingly positioned surface of the panel means relative to the secondary storage area.

In this fashion the panel means is specifically configured to be disposed in substantially over-lapping or closed relation to the compartment means so as to prevent removal or spillage of the various recreational articles or products from the compartment means.

BRIEF DESCRIPTION OF THE DRAWINGS

For a fuller understanding of the nature and objects of the invention, reference should be had to the following detailed description taken in connection with the following drawings, in which.

Similar reference characters refer to similar parts throughout the several views of the drawings.

DETAILED DESCRIPTION

Figure 1:
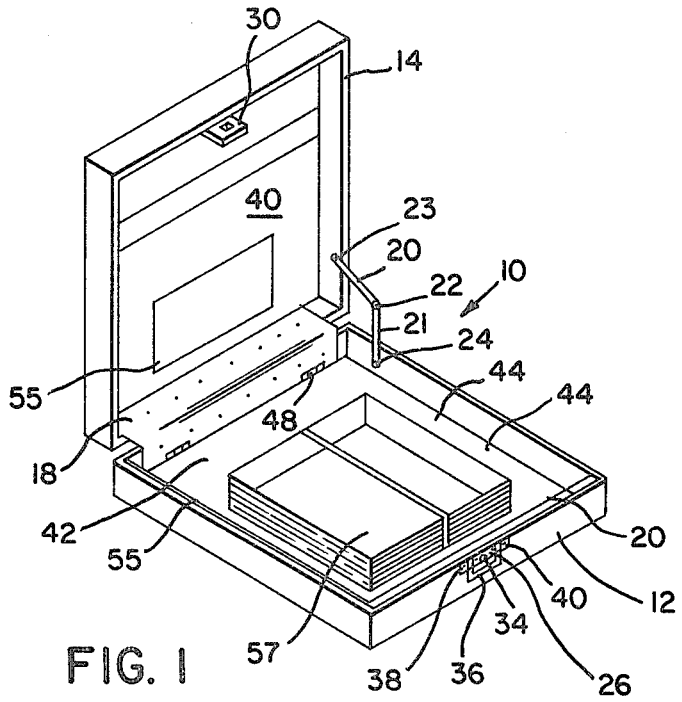
FIG. 1 is an isometric view of the housing of the present invention displaying the primary storage area wherein the lid means is positioned in its open relation relative to the base.
Figure 2:
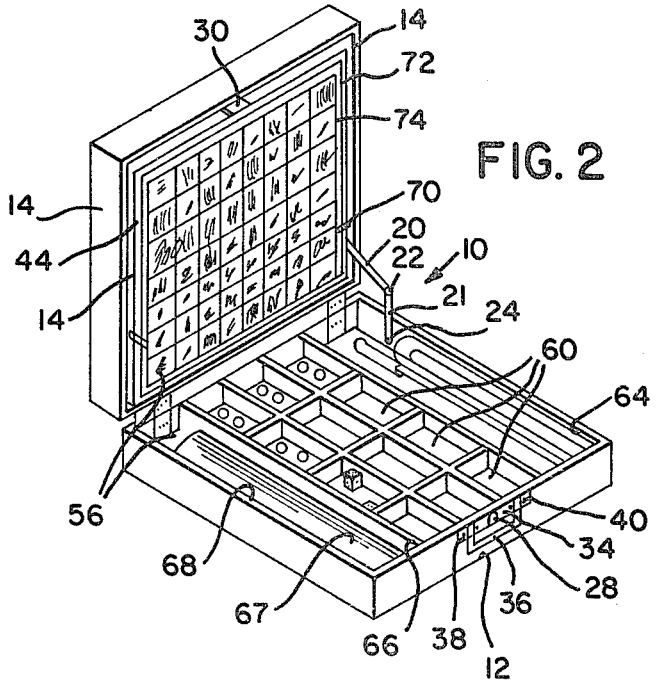
FIG. 2 is an isometric view of the housing of the present invention in its open position wherein the secondary storage area is disposed for access and display by positioning of the panel means in its open position relative to the secondary storage area.

As shown in both FIGS. 1 and 2 the housing of the combination recreational product assembly and conventional container is generally indicated as 10 and includes a base portion 12 and a lid means 14. In the preferred embodiment of the present invention as shown in both FIGS. 1 and 2 the housing is in the form of a conventional briefcase or attache case configuration and is generally meant, as will be explained in greater detail hereinafter, to function in the capacity of such a conventional container as well as being combined with a recreational product assembly as also will be described in greater detail hereinafter.

The base 12 and the lid means 14 are movably interconnected in a pivotal fashion due to hinge plate 16 being connected to the interior of both the base 12 and the lid 14 by conventional connectors 18. Actually any type of adhesive or stitching, etc., may be utilized to secure the hinge plate 16 to the interior surface portions of both the base 12 and the lid means 14 as best shown in FIG. 1. Hinge hardware in the form of a plurality of hinge arms 20 and 21 is also disposed in movable, interconnected relation between interior surfaces of the base 12 and the lid means 14 respectively. These hinge arms are pivotally attached to one another by pivot connector 22 and appropriate-type connectors at their distal ends as at 23 and 24. By virtue of these hinge type interconnecting means including hinge element 16 and the hinge arms 20 and 21, the lid means 14 is allowed to move in an open and closed relation relative to the base 12 in the conventional fashion as in ordinary briefcases or attache cases.

Other structural features of the housing include a fastener or lock means generally indicated as 26 including a lock element 28 and a fastening device 30 attached to the exterior of the base 12 and the lid means 14 respectively as also shown in FIGS. 1 and 2. A connecting plate 32 is also secured to the exterior surface 34 of the base 12 and is disposed to interconnect the lock means 28 to that exterior of the housing as well as to serve to have the user or owner's name engraved thereon also in a relatively conventional fashion. A handle element 36 may similarly be attached to the exterior of base 12 and be movably or pivotally attached at both its ends as at 38 and 41 so as to be movable relative to the exterior of the housing thereby lending itself for ease of holding as well as positioning in an "out of place" disposition when the housing is not being carried.

As seen both in FIGS. 1 and 2 the lid means 14 as well as the base 12 are both configured to have a substantially hollow interior generally indicated as 40 and 42 respectively. These hollow interiors 40 and 42 thereby define a substantially hollow interior of the housing 10 itself. A panel means 44 is movably connected to the interior of the housing. More specifically panel means 44 includes hinge connectors 46 and 48 secured to the interior surface 50 of the base as well as a peripheral or border position 52 of the panel means. These hinge elements 46 and 48 operate in the conventional manner and allow pivotal movement of the panel means 44 relative to the interior of the housing generally and the interior of the base 12 more specifically. Directional arrows 53 indicate the pivotal opening and closing motion of the panel means as best shown in FIG. 2. By virtue of the disposition of the panel means 44, the hollow interior of the housing is divided into a primary storage area which is clearly represented in FIG. 1 and generally indicated as 55 and a secondary storage area best represented in FIG. 2 and clearly and generally represented as 56.

As best shown in FIG. 1 the primary storage means 55 is generally configured and mentioned to contain conventional documents, briefs, letters, files, etc., as represented by article holder 57 and represents the conventional storage area in briefcases, attache cases or light conventional containers. Similarly, large pockets 43 are formed on the interior of lid 14 to hold letter or legal size papers. A smaller pocket or pockets 45 are secured to the exterior of these larger pockets 43 and are structred and dimensioned to hold pens, pencils, envelopes and like smaller articles.

The opposite side of panel means 44 comprises the secondary storage area 56 which includes the housing of a compartment means for various recreational articles or products. This secondary storage area is of course segregated from the primary storage area 55 by virtue of the existence of the panel means comprising, by virtue of its dimensions and disposition, a false bottom 44 prime (FIG. 1) and a lid element 44 double prime (FIG. 2) of the primary storage area 55 and the secondary storage area 56 respectively. FIG. 2 of course represents the secondary storage area in its access oriented or open position wherein the panel means 44 or secondary lid 44 double prime is disposed in its open position due to the interconnection of the interior of the base portion with the panel means by hinge elements 46 and 48 as described above.

The compartment means mentioned above comprises a plurality of individual compartments 60 in which are housed or maintained a plurality of recreational products or articles including dice, chips, markers, playing cards, etc., all indicated as 63. Additional compartments 64 may be specifically shaped to house various exercise devices, toys, thermoses, etc., which essentially may take up more room than the conventional and smaller recreational articles 63. It should be further noted that a separate compartment 66 may be included and may be insulated along its wall means 67 so as to allow a thermos element or like food container 68 to be placed therein and be maintained in a desired temperature range so that food stuffs can also be carried within the compartment means.

Yet another embodiment in the present invention comprises board mounting means which, in the preferred embodiment, include a pair of clip elements 70 physically secured to surface 72 of the panel means and configured, dimensioned and disposed so as to removably engage a peripheral portion or border edge of a playing board 74 which is mounted adjacent to the surface 72 of panel means 44. It is apparent that the clip element 70 may be positioned in various relationship to the playing board 74 and do not have to be arranged in specifically opposed relation to one another as long as the playing board 74 is securely fixed in the manner generally disclosed in FIG. 2.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A portable recreational product assembly convertible to a conventional container, said assembly and container comprising: a housing including a base and a lid means movably connected to one another and positionable between an open and a closed position, both said base and said lid means including a substantially hollow interior, panel means, pivotally mounted on the interior of said housing and disposed in segregating relation between predetermined portions of said housing interior; said predetermined portions of said housing interior comprising a primary storage area and a secondary storage area disposed in substantially segregated relation to one another on opposite sides of said panel; said panel means positionable between at least a partially closed and an open relation to said secondary storage area, whereby articles of diverse size and shape may be maintained and removed from each of said primary and secondary storage areas.

2. A product assembly as in claim 1 wherein said primary storage area comprises a portion of said hollow housing interior defined primarily between said lid means and a correspondingly positioned surface of said panel means.

3. A product assembly as in claim 2 wherein said primary storage area is mentioned and configured to contain conventional file documents and said container comprising an atache case.

4. A product assembly as in claim 1 wherein said secondary storage area comprises a portion of said hollow housing interior and is defined primarily between said base interior and the surface of said panel means correspondingly positioned relative to said secondary storage area.

5. A product assembly as in claim 1 wherein said secondary storage area comprises compartment means defined on the interior of said base between the interior surface thereof and a correspondingly positioned surface of said panel means.

6. A product assembly as in claim 5 wherein said compartment means comprises a plurality of compartments mounted on the interior surface of said base and disposed and spaced apart, substantially segregated in relation to one another.

7. A product assembly as in claim 6 wherein a predetermined number of said plurality of compartments are of varying size and configuration from certain other ones of said plurality of compartments, whereby recreational articles are stored within any one of said plurality of compartments.

8. A product assembly as in claim 6 wherein said panel means is movable into over-lapping covering position relative to at least some of said plurality compartments, whereby the position of said panel means prevents inadvertent displacement of the articles from said compartments.

9. A product assembly as in claim 1 further comprising board mounting means connected to said panel means and disposed in board retaining position on the interior surface of said panel means.

10. A product assembly as in claim 9 wherein said board mounting means comprises clip means mounted adjacent a peripheral portion of said panel means in over-lapping relation to a game board mounted thereon, said clip dimensioned, configured and disposed to removably mount the board on a predetermined surface of said panel means.

* * * * *